US005337831A

United States Patent [19]

Chopp

[11] Patent Number: 5,337,831

[45] Date of Patent: Aug. 16, 1994

[54] POWER-DRIVEN GOLF CUP CUTTER

[76] Inventor: Timothy J. Chopp, 3412 Westwood Farms Dr., Louisville, Ky. 40220

[21] Appl. No.: 990,014

[22] Filed: Dec. 14, 1992

[51] Int. Cl.[5] ..... E21B 12/06; A01B 45/00

[52] U.S. Cl. ..... 172/22

[58] Field of Search ..... 172/22, 19, 20, 21; 273/34 R, 34 A, 34 B; 408/704, 705

[56] References Cited

U.S. PATENT DOCUMENTS

| | | | |
|---|---|---|---|
| 1,783,026 | 11/1930 | Ober | 172/22 X |
| 3,817,337 | 6/1974 | Panak et al. | 172/22 X |
| 4,947,938 | 8/1990 | Fricke et al. | 172/22 |
| 4,958,688 | 9/1990 | Marrow et al. | 172/22 |

*Primary Examiner*—George J. Marlo

[57] ABSTRACT

A power-driven golf cup cutter is provided in which a power source, such as an internal combustion engine, is used to rotate a hollow cutting cylinder by means of a drive shaft. The cylinder has a first open end with an even, single-plane sharpened edge engageable with the ground, an opposite closed and substantially solid end and has an outer peripheral surface which is continuous and smooth. An axially slidable first plate is carried on a plurality of rods extending through apertures in the solid end of the hollow cylinder, the plate engaging the ground which is to be removed. The rods are connected to a second plate member carried on and axially slidable relative to the drive shaft. The second plate is selectively moved by a user solely axially relative to the hollow cylinder and the removed ground to cause the first plate to be moved to expel the ground from within the hollow cylinder.

7 Claims, 2 Drawing Sheets

FIG. 1
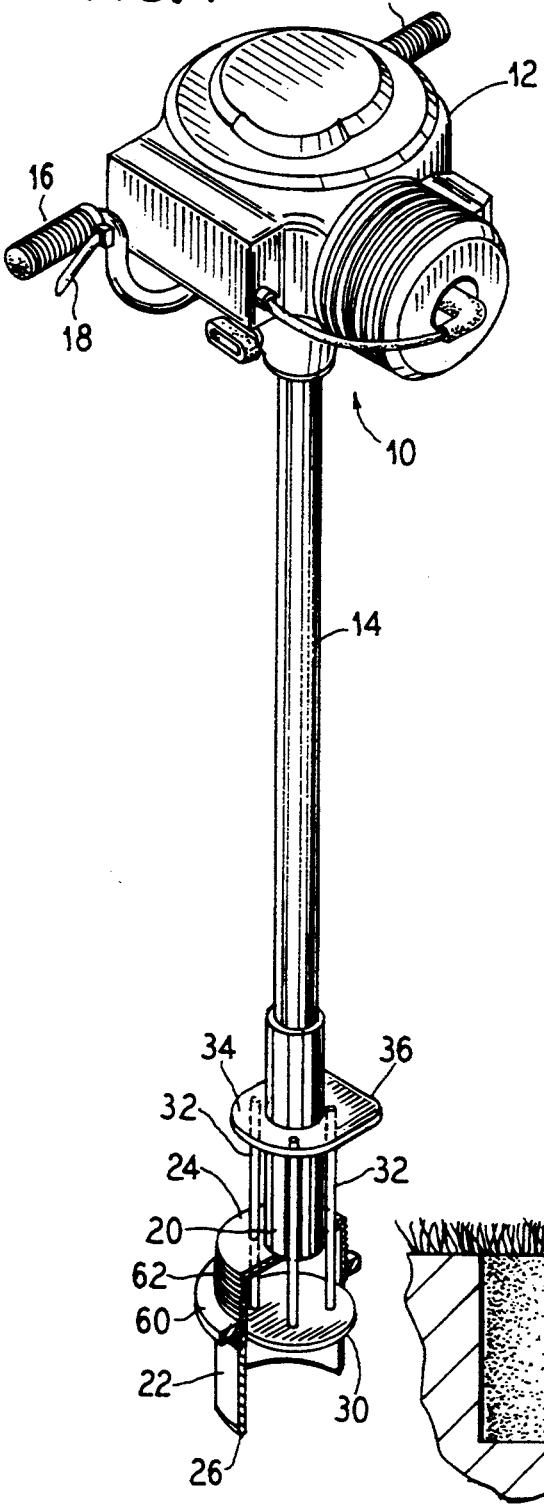
FIG. 2
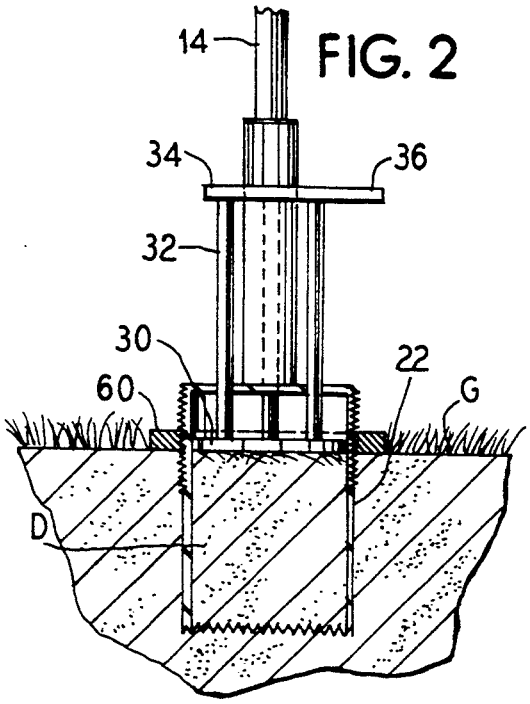
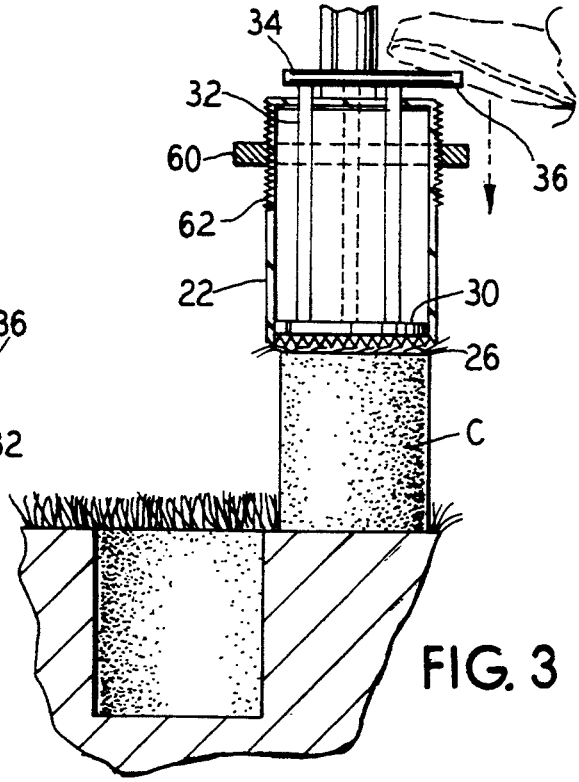
FIG. 3

POWER-DRIVEN GOLF CUP CUTTER

BACKGROUND OF THE INVENTION

The present invention relates to tools for cutting golf cups and in particular to a power-driven tool.

Tools for cutting golf cups are known and generally comprised a non-powered device in which a hollow cylinder is carried on one end of a pole and two handles extend laterally from the other end of the pole in a general T-shape. To cut a hole a person needs to press downwardly on the handles while twisting the pole back and forth until the hollow cylinder is pressed into the ground a sufficient degree to achieve a desired depth. Use of this type of a manual device has several drawbacks including exposing the user to carpal tunnel syndrome and other strain/sprain-types of injuries associated with wrist extension/flexion, palm pressures and repetitive tasks. Also, the hole achieved by use of such a manual device is not always precise due to the failure to maintain a vertical orientation of the pole during the twisting and pushing process. Further, achieving a consistent depth for each hole is problematic.

SUMMARY OF THE INVENTION

The present invention provides a power-driven golf cup cutter in which a power means, such as an internal combustion engine, is used to rotate a shaft. Grasping means, preferably in the form of handles, are provided on the power means. A hollow cylinder is attached for rotation with the shaft. The hollow cylinder has an open end which is engageable with the ground. Selectively movable means are carried within the cylinder to be used to expel dirt from within the cylinder after the cup is cut.

Preferably the open end of the cylinder is defined by a sharp edge to assist in the cutting process. The movable means carried within the cylinder may comprise a plate member which is free to float within the cylinder and may include a radially extending portion engageable by the user to effect axial movement of the plate member for ejecting the core of dirt removed while cutting the cup. In one embodiment the plate has a plurality of posts extending upwardly therefrom which extend through a top wall of the cylinder. The posts are secured to a second plate which is also carried on the shaft and which has a radially extending portion which can be engaged by a user's foot to selectively press down to cause the plate to move downwardly within the cylinder ejecting the dirt. In another embodiment a mechanical arrangement such as a ratchet mechanism or rack and pinion mechanism or other similar arrangement can be used to cause the plate to move downwardly.

A flange may be carried on an outer peripheral surface of the cylinder which is axially adjustable on the cylinder to provide a depth gauge to permit consistent depths for various holes.

BRIEF DESCRIPTION OF THE DRAWINGS

FIG. 1 is a perspective view of a power-driven golf cup cutter embodying the principles of the present invention.

FIG. 2 is a side sectional view of an embodiment of the cutter and cylinder portion with the cylinder fully engaged into the ground.

FIG. 3 is a side sectional view of the cylinder of FIG. 2 showing ejection of the cut dirt core.

DETAILED DESCRIPTION OF THE PREFERRED EMBODIMENTS

Figure 4:
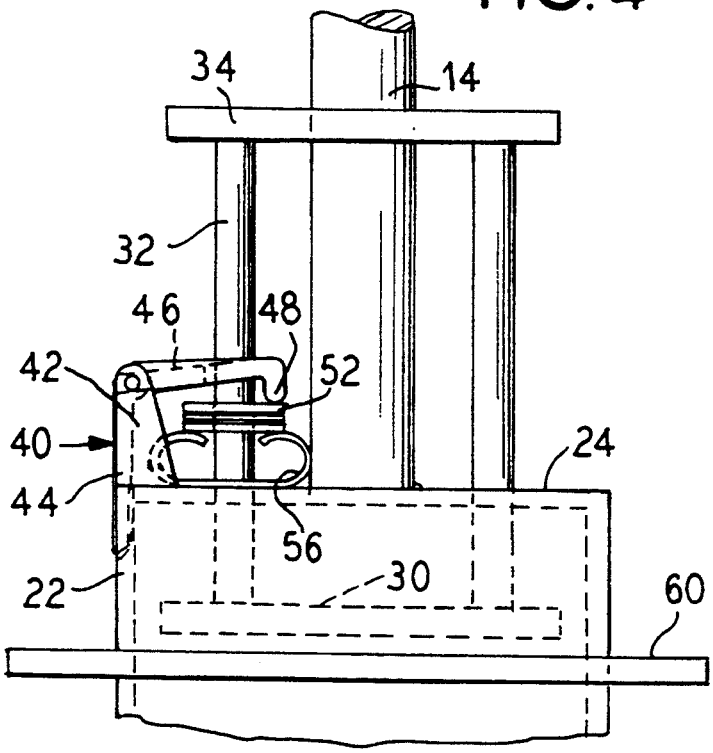
FIG. 4 is a partial side sectional view of a mechanical arrangement for moving the dirt ejecting plate downwardly.

In FIG. 1 there is illustrated a power-driven golf cup cutter generally at 10 which includes a power means 12 in the form of an internal combustion engine which has a shaft 14 extending therefrom. The engine 12, when operated above a certain power level, will cause the shaft 14 to rotate. A pair of handles 16 extend laterally from the engine 12 and provide a means for a user to grasp and direct the engine 12. A throttle control 18 is associated with one of the handles 16 to vary the speed of rotation of the shaft 14. A centrifugal clutch can be used, as is known with internal combustion engines, to permit the shaft 14 to remain stationary at an idle speed of the engine 12, but to rotate given a sufficiently high rpm of the engine.

A lower end 20 of the shaft 14 is attached to a hollow cylinder 22 at a substantially solid top wall 24. The cylinder 22 has an open bottom end 26. The end can be defined by a sharp edge which is either smooth as shown in FIG. 1 or is serrated as shown in FIGS. 2 and 3. Carried within the cylinder is a plate 30 which provides a means which is selectively axially movable to expel dirt from within the cylinder after a hole is cut. In the embodiment illustrated in FIGS. 1–3, the plate has a plurality of posts 32 extending upwardly therefrom which pass through apertures in the otherwise solid top wall 24 of the cylinder 22. A second plate 34 is secured to a top end of the posts 32 and has a portion 36 which extends radially further than the remainder of the plate 34 so as to be engageable by a person using the device to effect an axial movement of the plate 30, such as by the downward pressing on the extending portion 36 by a user's foot as illustrated in FIG. 3. The plate 30 essentially floats within the cylinder 22 and as the cylinder cuts its way into the ground G as illustrated in FIG. 2, dirt D fills the interior of the cylinder 22 pressing the plate 30 upwardly. To remove the dirt D from the cylinder 22, the user presses downwardly on the extension 36 causing a core C of dirt to be ejected from the cylinder. Such a core C could be deposited directly into a previously used cup to facilitate restoration of the putting green.

Figure 5:
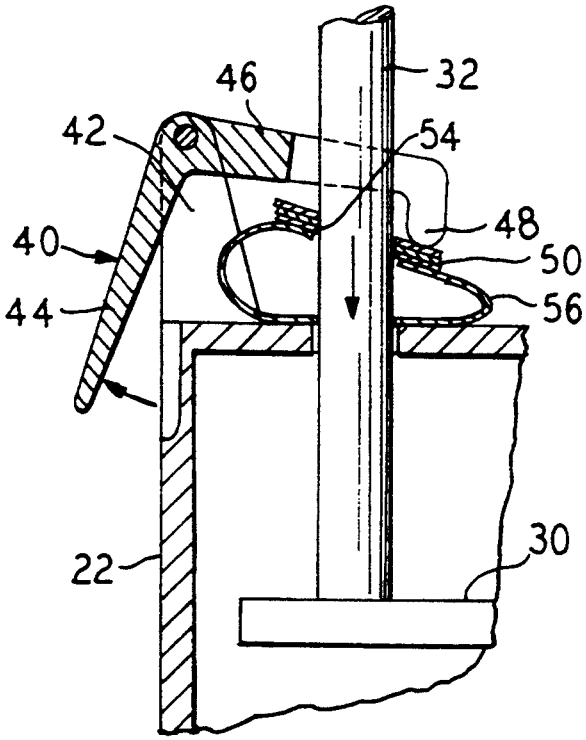
FIG. 5 is a partial side sectional view of the embodiment of FIG. 4 in operation.

FIGS. 4 and 5 illustrate an alternate embodiment of a means for axially moving the plate 30. This arrangement provides a ratchet mechanism for causing the plate 30 to move downwardly. One or more crank members 40 can be pivotally attached to the cylinder 22 or a vertical extension 42 thereof. A first arm 44 of the crank is to be used for grasping by the user. A second arm 46 of the crank 40 has a nose portion 48 which rests on a top surface 50 of a stack of washers 52 having an internal diameter 54 slightly larger than a diameter of the rod 32 extending between the plate 30 and the top plate 34. Return springs 56 are provided between the top wall 24 of the cylinder 22 and bottom of the washer stack 52 to continuously urge the washers 52 upwardly against the nose 48 of the crank 40. As the crank 40 is rotated, the washers 52 are tilted with respect to the post 32 causing an edge of the interior opening of the washers to grip the post 32 and to move it downwardly. As the crank 40 is returned to its original position, the springs 56 return the washers 52 upwardly slidingly along the post 32 allowing the washers, in a subsequent cranking movement, to engage a higher portion of the post 32 to continue to move the post downwardly.

Many other types of mechanical arrangements such as rack ratchets, rack and pinion devices, etc. can be provided to drive the plate 30 downwardly within the cylinder 22.

A flange 60 preferably is carried on an exterior peripheral surface of the cylinder 22 and is arranged to be axially adjustable with respect to the cylinder. For example, a portion of the exterior surface of the cylinder 22 can be threaded as at 62 and the flange can have an interior threaded surface to permit the flange to be moved axially relative to the cylinder. The flange 60 will provide a depth gauge for the cup cutter so that consistent depths can be cut for a number of holes.

Other means for adjustably carrying the flange 60 on the cylinder 22 can be provided, such as a series of axially spaced detents along the length of the cylinder 22 with spring loaded balls or other similar arrangements carried on the flange 60 to permit an axial position to be selected for the flange, which position will be maintained until the user specifically moves the flange.

Thus it is seen that the present invention provides a golf cup cutting device which, due to its powering and configuration, permits a user to easily and quickly cut a number of golf cups in the ground, all to a consistent selected depth, if desired, and each in a precise manner.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A power-driven golf cup cutter for removing a solid cylinder of dirt from an area of ground to form said cup comprising:

power means having a rotatable drive shaft extending therefrom and handles for manually grasping and holding said engine, a hollow cylinder attached to said drive shaft for rotation therewith with a first open end having a single-plane sharpened edge engageable with the ground and an opposite closed and substantially solid end, an outer peripheral surface of the lower end of said drive shaft being continuous and smooth, and an axially slidable first plate member carried on a plurality of rods extending through apertures formed in said closed and substantially solid end, said first plate member being positioned within said hollow cylinder to engage a top end of said solid cylinder of dirt, said rods being connected to a second plate member carried on and axially slidable relative to said lower end of said drive shaft above said hollow cylinder and extending radially of said lower end of said drive shaft, said second plate member to be selectively moved by a user solely axially relative to said hollow cylinder and said solid cylinder of dirt to cause said first plate member to be moved to expel said solid cylinder of dirt from within said hollow cylinder.

2. A power-driven golf cup cutter according to claim 1, wherein said power means is an internal combustion engine.

3. A power-driven golf cup cutter according to claim 1, wherein said handles extend laterally from opposite sides of said engine.

4. A power-driven golf cup cutter according to claim 1, wherein mechanical means are attached to said plate member to assist effecting axial movement of said plate member.

5. A power-driven golf cup cutter according to claim 1, including means for adjusting a depth that said cylinder can engage the ground.

6. A power-driven golf cup cutter according to claim 5, wherein said means for adjusting a depth comprises a flange carried on an outer peripheral surface of said cylinder.

7. A power-driven golf cup cutter according to claim 6, wherein said flange is threadingly carried on said cylinder.

* * * * *